United States Patent [19]

Bauer

[11] 4,377,042

[45] Mar. 22, 1983

[54] FOOTWEAR HAVING REMOVABLE SOLE

[76] Inventor: Peter Bauer, 5500 132 NE., Bellevue, Wash. 98005

[21] Appl. No.: 226,231

[22] Filed: Jan. 19, 1981

Related U.S. Application Data

[63] Continuation-in-part of Ser. No. 61,924, Jul. 30, 1979.

[51] Int. Cl.[3] ..... A43B 3/24; A43C 13/00

[52] U.S. Cl. ..... 36/101; 36/15

[58] Field of Search ..... 36/100, 101, 15

[56] References Cited

U.S. PATENT DOCUMENTS

| | | | |
|---|---|---|---|
| 2,178,025 | 10/1939 | Richter | 36/101 |
| 2,183,277 | 12/1939 | Heilhocker | 36/101 |
| 2,761,224 | 9/1956 | Gardiner | 36/101 |
| 4,062,132 | 12/1977 | Klimaszewski | 36/100 |

*Primary Examiner*—Patrick D. Lawson

[57] ABSTRACT

Athletic shoes with removable outsoles are disclosed. Each upper is designed to fit an individual foot and ankle of a particular wearer and such upper is provided with an insole securely and permanently connected therewith. Each insole terminates along its peripheral margin with one part of a bead-and-recess mechanically detachable locking member. A removable outsole is provided with a surface contacting tread which is selected to not only best match the surface of a particular sports area but also the condition of such surface at a particular time of use. A flexible member is permanently connected with the outsole and terminates along its peripheral margin with the other part of the mechanical locking member. The outsole and the insole are further connected together by mating Velcro and Duallock members, tongues and grooves carried by the outsole and insole in paired relations, and other interlocking means. The forms and shapes of the bead and recess parts of the bead-and-recess mechanically detachable locking member are illustrated and described.

5 Claims, 6 Drawing Figures

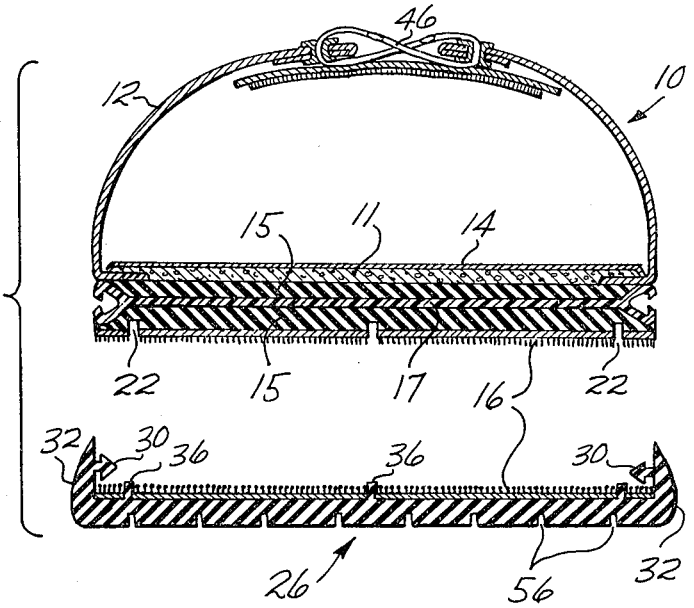
Fig. 3
Fig. 4
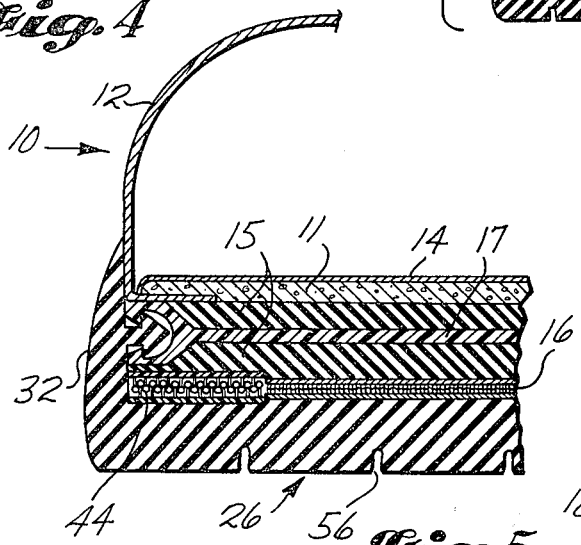
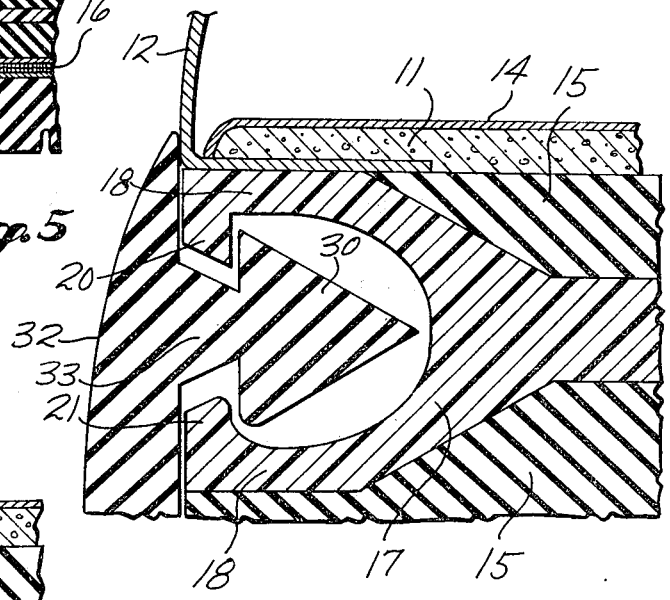
Fig. 5
Fig. 6
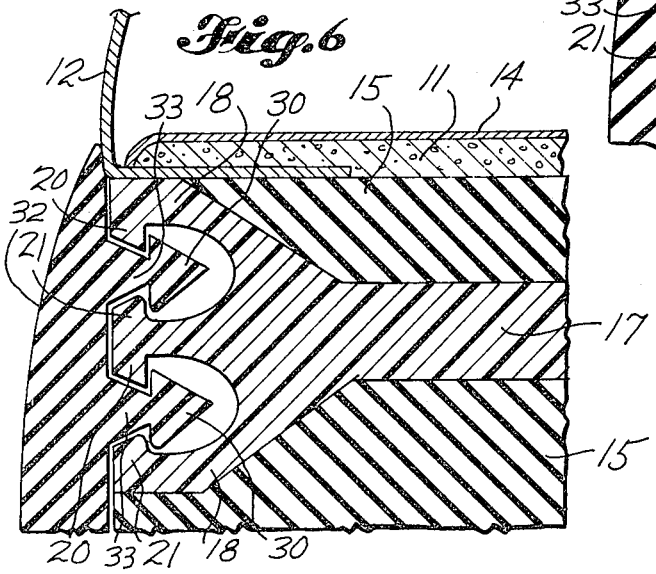

FOOTWEAR HAVING REMOVABLE SOLE

CROSS REFERENCE TO RELATED APPLICATION

The present application is a continuation-in-part of my pending application, Ser. No. 06/061,924, filed July 30, 1979, for SHOE WITH REMOVABLE OUTSOLE.

BACKGROUND OF THE INVENTION

The invention of my patent application, of which the present is a continuation-in-part, relates to athletic shoes having replacement outsoles. This provides for utmost utility of the uppers without soles designed to permit better participation in various sports and on fields or arenas having various surfaces for foot engagement therewith.

From applicant's prior search and the search of the Examiner in said parent application, of which the present application is a continuation-in-part, applicant is aware of the prior art of the following Letters Patent:

| U.S. LETTERS PATENT | | |
|---|---|---|
| PATENTEE | U.S. Pat. No. | ISSUE DATE |
| M. C. Clark | 980,173 | Dec. 27, 1910 |
| M. Rasmussen | 1,051,448 | Jan. 28, 1913 |
| F. Victor | 1,318,247 | Oct. 7, 1919 |
| W. M. Jessup | 1,341,323 | May 25, 1920 |
| A. Siekacz | 1,773,242 | Aug. 19, 1930 |
| E. Richter | 2,178,025 | Oct. 31, 1939 |
| E. C. Heilhecker | 2,183,277 | Dec. 12, 1939 |
| J. Fein | 2,200,080 | May 7, 1940 |
| S. H. Geffner | 2,205,091 | June 18, 1940 |
| W. Epsztejn | 2,528,951 | Nov. 7, 1950 |
| E. Danielius | 2,552,943 | May 15, 1951 |
| M. Sabbagh | 2,664,650 | Jan. 5, 1954 |
| W. C. C. Burton, Jr. | 2,839,845 | June 24, 1958 |
| J. H. Parker | 2,930,148 | Mar. 29, 1960 |
| C. B. Reinhart | 3,012,340 | Dec. 12, 1961 |
| R. T. Kauffman et al | 3,019,534 | Feb. 6, 1962 |
| A. Herschdorf | 3,083,476 | April 2, 1963 |
| M. Sachs | 3,686,779 | Aug. 29, 1972 |
| Claude-Roger Isman | 3,878,626 | Apr. 22, 1975 |
| C. Klimaszemski | 4,062,132 | Dec. 13, 1977 |
| FOREIGN PATENTS | | |
| Claude-Roger Isman (German) | 2,217,397 | Nov. 30, 1972 |

From the examination of such prior patents and the disclosures thereof, it will be apparent that heretofore a long-felt need for an athletic shoe with a replaceable outsole which will withstand the rigors of athletic endeavors on playing surfaces which vary widely, existed and is herein met.

BRIEF DESCRIPTION OF THE INVENTION

The present invention particularly relates to the connecting means disposed between the uppers and the removable and replaceable outsole. The uppers and tread of the removable outsole may follow the teachings of my application of which this application is a continuation-in-part. The objects of this invention are to provide a shoe having an upper and an insole connected therewith. The insole terminates in one part of a longitudinally extending bead and longitudinally extending mating recess mechanical locking means. The other part of said locking means is carried by a flexible member and such flexible member carries the outsole.

More particularly, the mechanical locking bead part comprises a neck portion and an interlocking head portion, particularly a head portion which is substantially triangular in section and with a base portion connected and symmetrical with the head portion.

A recess portion mates with the head portion and comprises two spaced apart leg members providing a bead-receiving recess where the bead hook members connect with the leg members, extend toward each other, and are directed normally of the leg member.

The recess and bead portions of the locking means are preferably formed of a plastic, such as polyethylene or urethane.

In one form of my invention, I provide one set of bead and mating recess members and in another form of my invention, such parts are duplicated.

Further objects and advantages of my invention will become explicit and implicit to one skilled in the art to which this invention pertains upon consideration of the following detailed description of my inventions.

DESCRIPTION OF THE DRAWINGS

A more complete understanding of my invention may be had be reference to the accompanying drawings illustrating preferred forms and embodiments of my invention in which like reference numerals refer to like parts throughout the several figures and in which:

FIG. 3 is an exploded sectional view taken substantially on broken line 3—3 of FIG. 1 but with the upper and the lower parts of FIG. 1 separated;

FIG. 4 is a somewhat enlarged fragmentary sectional view and taken substantially on broken line 5—5 of FIG. 1;

FIG. 5 is an enlarged fragmentary view illustrating the mating relation between the bead and groove parts; and FIG. 6 is a sectional view similar to FIG. 4 showing a modified form of the invention.

DESCRIPTION OF THE PREFERRED EMBODIMENTS

Figure 1:
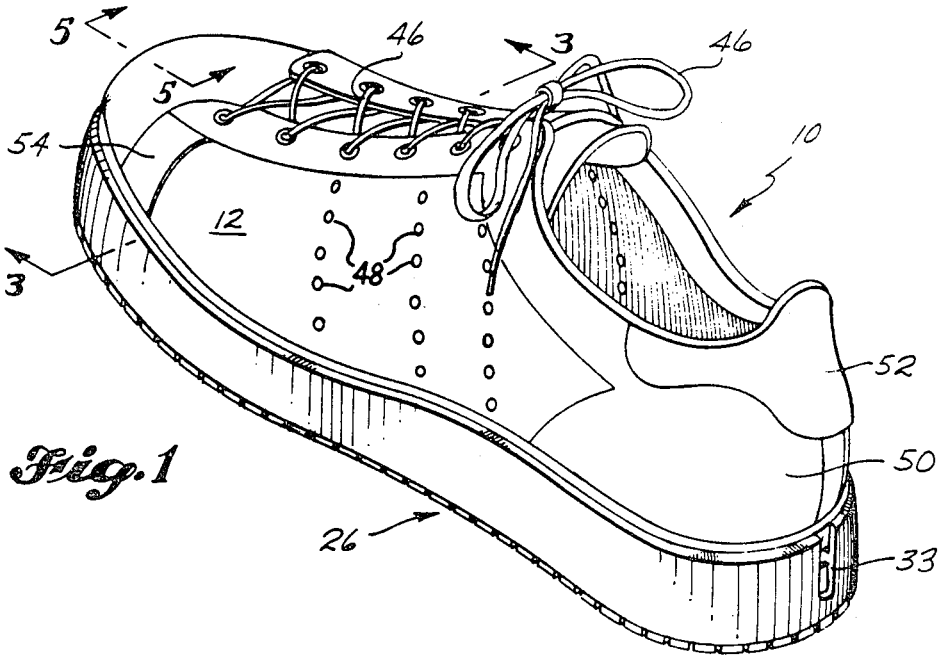
FIG. 1 is a perspective view of a sport shoe having a low-cut upper connected with a detachable or removable outsole embodying my invention.

An upper shoe part, generally designated as 10, is preferably custon made so that a pair thereof will adequately fit the feet and ankles of a particular wearer. As many types of treads or soles may be carried by a single set of uppers 10 to meet the conditions required by a particular field or track and on a particular condition thereof or a particular day, it is felt that such custom tailoring of the uppers 10 is warranted as is highly recommended, when the uppers can be detachably connected to a selected sole unit.

The upper 10 includes surface portion 12 and insole 14. The recess-providing part 17 of the longitudinally extending mechanical locking means is preferably laminated between two layers of sponge rubber 15 to form a unit. This unit is adhered to the insole 14 and the end portions of the surface 12 by a suitable adhesive layer 11. The unit 15, 17 is adhesively connected with one part of a Velcro or, preferably, a Duallock detachable mechanical binder 16. Duallock is the trademark product manufactured and sold by Minnesota Mining and Manufacturing Co.

The recess-providing part 17 comprises two spaced apart leg members 18 which carry bead hook members 20 and 21, which are, respectively, connected to the leg members, project toward each other, and are normal to the leg members. The two intersecting surfaces forming the upper hook member 20 are formed by two surfaces which intersect to form an acute angle whereas, the two surfaces which meet to provide the corresponding juncture of the lower hook member 21 are arcuate. Thus, in folding the vertical strip 32 connected with outsole 26 away from the recess part 17, it is more difficult to release the head part 30 from the upper bead hook member 20 than it is to remove the bead part from the lower bead hook member 21 because of the sharp angle on the one and the rounded corner on the other.

The head part of the longitudinally extending bead and recess mechanical locking means comprises a head portion 30 which is substantially triangular in section and its base is connected with its neck 34 which is symmetrical therewith and the base is normal of the portion 30 and the neck is connected with the vertical strip 32.

Figure 2:
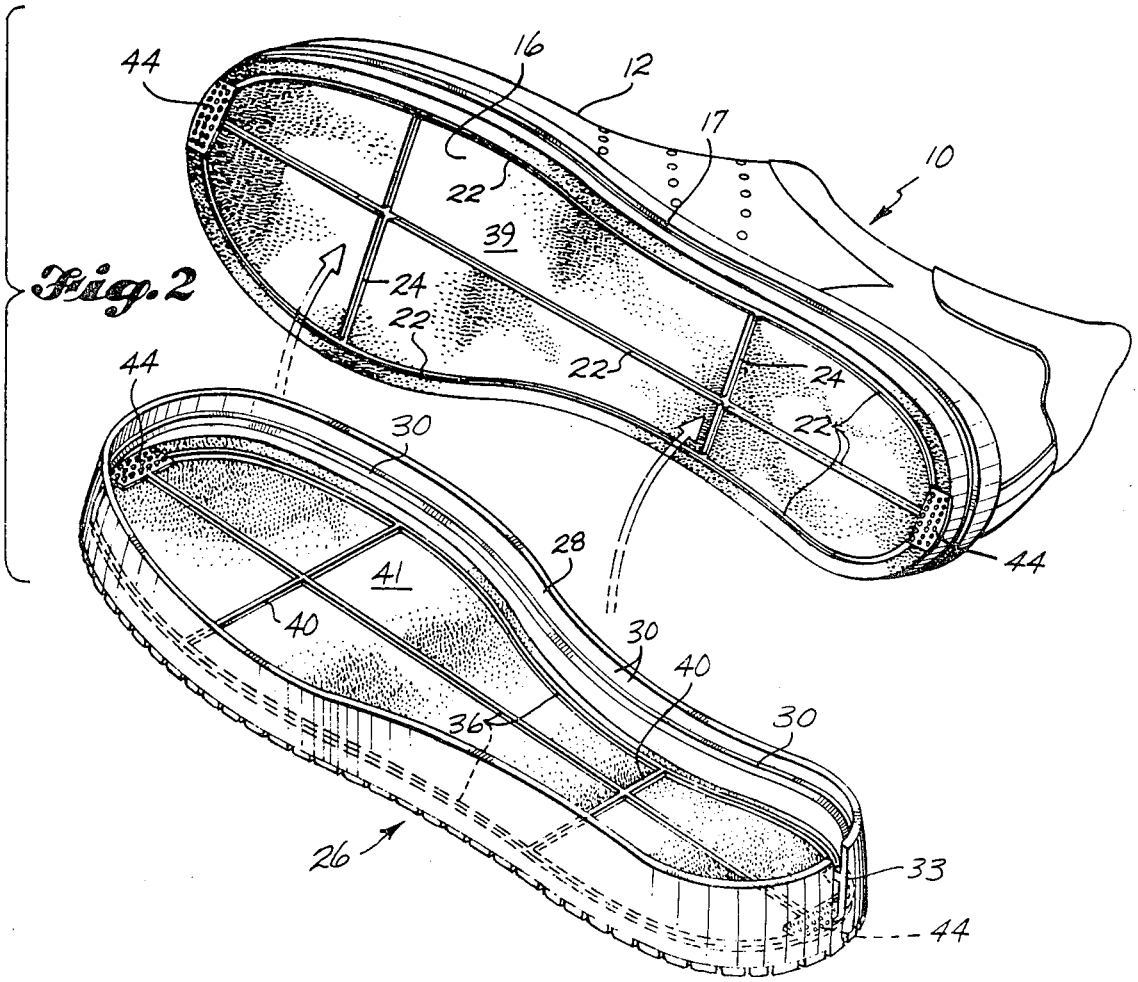
FIG. 2 is an exploded perspective view showing the upper removed from the lower or outsole.

The lower surface of the insole 14 is preferably provided (FIG. 2) with a plurality of longitudinally extending grooves 22 and a plurality of crosswise extending grooves 24. The upper terminal portions of the grooves 22 and 24 (FIG. 3) are preferably circular in section.

The outsole 26 (FIGS. 3 and 5) carries the bead for the remaining part of the bead-and-recess locking means, and preferably, the beads 30 are triangular in section as described. The bead 30 may be urged into and will snugly fit in the recess provided between the leg members 18 carried by the strip 32. As the strip 32 is formed of flexible material, the strip may be flexed during the removing or securing of the outsole 26 from or to the insole 14 of the upper 10.

As the beads 30 or recesses between legs 18 may be carried or connected with the insole 14 as well as with the outsole 26, it has been stated and claimed that one part of the bead-and-recess mechanical locking means is carried by the upper 10 and the other part thereof is carried by the outsole 26.

The upper surface of the outsole 26 is preferably provided with a plurality of upstanding projecting, longitudinally extending ribs 36 and the insole 16 is provided with mating recesses or grooves 22. Also, the upper surface of the outsole 26 is preferably provided with a plurality of upwardly projecting, crosswise extending ribs 40 (FIG. 2) and the insole 16 is provided with mating recesses 24. Again, obviously, the insole 16 could have the ribs and the outsole 26 could have the grooves.

As previously stated, additional locking construction is employed between the insole and the outsole where one part employs a part 39 of Velcro or Duallock connector carried by the bottom of insole 16 and the mating connector member 41 is carried by the upper surface of the outsole 26.

At the toe end portion, further additional engaging means is preferably provided to withstand and prevent relative movement between the insole 14 and the outsole 26 and a similar engaging means is provided at the heel portion of the shoe for the same purpose. Often, players drive their toes or heels into the ground to clear away debris from the surface of the outsole 26. The additional engaging means comprises two sets of detachable connectors 44, each set comprising a plurality of projecting shafts with terminal balls and with one set carried by the insole 16 and the other set carried by the outsole 26. These detachable connectors 44 may be of the type sold by Minnesota Mining and Manufacturing Co. under the tradename of Duallock.

In the drawings, the upper 10 is illustrated by a low-cut shoe but, obviously, some players use high-cut shoes and the same are included by reference. Also, the laces 46 vent holes 48, heels 50, and reinforcing strips 52 and 54 are included only as illustrations of parts of standard shoes. Also, the tread 56 on the bottom of the outsole 26 is only illustrative of the many treads that may be carried by the outsole 26.

In installing the outsole 26 to the upper 10, the toe portion of the upper 10 is aligned with the toe portion of the outer sole 26 and the forward detachable connectors 44, carried by each, are firmly and positively engaged with the flexible strip 32 bent away from the recess-providing part 17 so as not to interfere. At the same time, caution should be exercised to ensure that (1) the longitudinal ribs 36 and the cross ribs 40 of the outsole 26 mesh with the grooves 24 and 22 of the insole 14; and (2) the vertical strip 32 is properly urged into place with the head portion 30 properly inserted into the recess between leg members 18 and upper and lower hook members 20 and 21. As the strip 32 is cut away at the opening 32 at the rear, the strip 32 can be properly manipulated to permit the aligning of the various recesses and beads. After such aligning and any final adjustments or manipulations, the rearward detachable connectors 44 are firmly engaged with each other.

The modification of the invention illustrated in FIG. 6 shows the strip member 32 carrying two head portions 30 and associate parts for reception in two mating recesses therefor. Thus, there is illustrated a plurality of longitudinally extending mating bead-and-recess mechanical locking means which may be employed in the various ways illustrated and described in connection with the single bead-and-recess means in the preceding description.

RESTATEMENT OF THE INVENTION

From the foregoing, it is obvious that I have provided a shoe comprising an upper, such as 10. This upper 10 is connected, as by adhesive layer 11, with one part of a bead-and-recess mechanical locking means. In other words, either the bead or the recess part thereof may be carried by the upper 10 and as an illustration thereof, recess-providing strip 17 may be adhesively secured to the upper 10.

Next, a removable outsole 26 is shown and a flexible member, such as 32, is provided. This strip 32 is illustrated as carried by the outsole 26 but again, the same could be carried by the upper 10. As the recess 17 is shown as carried by the upper 10, the strip 32 is shown as carrying the bead portion 30, 33 which mate with the recess 17 and complete the bead-and-recess mechanical locking means between the upper 10 and the outsole 26.

There are a number of additional locking means, which I feel desirable for athletic shoes, between the upper 10 and the outsole 26. One thereof includes the mating parts 39 and 41 of the Velcro or Duallock surfaces, one thereof carried by the insole 14 and the other thereof carried by the outsole 26.

The lower surface of the outsole 26 is provided with a pleated pattern or tread 56 or illustrate the many non-skid type of treads which may be provided on the bottom of outsole 26.

The recess part 17 of the longitudinally extending and mating recess mechanical locking means comprises two spaced apart leg member 18 providing therebetween a bead-receiving recess to receive the head portion 30 of the bead part of said longitudinally extending bead and longitudinally extending and mating recess mechanical locking means. The two leg members 18 terminate in upper and lower bead hook members 20 and 21 which extend toward each other and which are directed normally of the leg members.

The recess member 17, preferably, is formed of a plastic, such as polyethylene or urethane.

As illustrated, preferably the bead part of the longitudinally extending bead-and-recess mechanical locking means is carried by the outsole 26, as through vertical strip 32. Similarly, the longitudinally extending recess part of the longitudinally extending and mating recess member is carried by or connected with the upper 10.

As indicated by FIG. 6 of the drawing, the longitudinally extending bead and mating recess mechanical locking means comprises duplicate beads and duplicate recesses.

As indicated in FIG. 5 of the drawings, the bead portion of the longitudinally extending bead and mating recess mechanical locking means comprises a head portion 30 which has a first face member and a second face member which extends arcuately as respects the first face member.

Preferably, an additional locking means is provided between the upper 10 and the outsole 26 as by mating layers of Duallock, Also, the recess-providing part 17 is preferably laminated between two cushion layers, as layers 15 of foam.

Obviously, changes may be made in the forms, dimensions, and arrangements of the parts of my invention without departing from the principle thereof, the above setting forth only preferred forms of embodiment of my invention.

I claim:

1. A shoe comprising an upper; an insole connected with the upper, said insole terminating along its peripheral margins in one part of a longitudinally extending bead and longitudinally extending and mating recess mechanical locking means, said longitudinally extending bead part comprising beads which have a neck portion and a head portion relatively larger than said neck portion; a removable outsole; and a flexible member connected with said outsole, extending outwardly of said insole, and terminating along its peripheral margins with the other part of the longitudinally extending bead and longitudinally extending recess mechanical locking means, said flexible member flexing inwardly and outwardly and permitting entrance and exit of said bead part into and out of said mating recess.

2. The combination of claim 1, wherein the recess part of the longitudinally extending bead and longitudinally extending and mating recess mechanical locking means comprises two spaced apart leg members providing therebetween a bead-receiving recess, and bead hook members connected with the leg members, extending toward each other, and directed normally of the leg members and the bead part of the longitudinally extending bead and longitudinally extending and mating recess mechanical locking means comprising a neck portion and an interconnected head portion, said head portion having a base extending substantially normal to the neck portion.

3. The combination of claim 1, wherein the longitudinally extending bead part is connected with said flexible member.

4. The combination of claim 1, wherein duplicate bead and recess means are provided and one part thereof is connected with the flexible member and the other part thereof is connected with the removable outsole.

5. The combination of claim 1, wherein Duallock detachably securing members are provided, one carried by the outsole and the other carried by the insole.

* * * * *